US006059135A

United States Patent [19]

James et al.

[11] Patent Number: 6,059,135

[45] Date of Patent: May 9, 2000

[54] SAFETY CONTAINER FOR STORING ITEMS

[75] Inventors: John James, 2227 Island Home Blvd., Knoxville, Tenn. 37920; Wendy Gilhula, Knoxville, Tenn.; Linda Gullette Hudson, Knoxville, Tenn.; Donna Poling, Knoxville, Tenn.

[73] Assignee: John James, Knoxville, Tenn.

[21] Appl. No.: 08/940,184

[22] Filed: Sep. 30, 1997

[51] Int. Cl.[7] ..... B65D 1/24; B65D 45/28

[52] U.S. Cl. ..... 220/23.4; 220/23.83; 220/244; 220/250; 220/323; 220/533; 220/833; 292/162

[58] Field of Search ..... 220/23.2, 23.4, 220/23.83, 243, 244, 249, 250, 251, 314, 315, 323, 528, 529, 532, 533, 552, 810, 826, 833, 524, 525; 312/216; 292/162

[56] References Cited

U.S. PATENT DOCUMENTS

| | | | |
|---|---|---|---|
| 1,281,587 | 10/1918 | Kovachevich | 220/524 X |
| 3,338,452 | 8/1967 | Oakley et al. | 220/23.4 |
| 3,425,586 | 2/1969 | Petters et al. | 220/23.4 |
| 3,823,817 | 7/1974 | Hughes | 220/524 X |
| 3,973,687 | 8/1976 | Glick . | |
| 4,462,501 | 7/1984 | Franchi . | |
| 4,535,903 | 8/1985 | Franchi . | |
| 4,889,254 | 12/1989 | Vola | 220/23.4 |
| 5,024,067 | 6/1991 | Maier, II | 220/23.4 X |
| 5,284,262 | 2/1994 | O"Nan . | |
| 5,346,069 | 9/1994 | Intini . | |
| 5,575,399 | 11/1996 | Intini . | |

*Primary Examiner*—Allan N. Shoap
*Assistant Examiner*—Joe Merek
*Attorney, Agent, or Firm*—Rick Barnes

[57] ABSTRACT

A safety container is described which can simultaneously store and secure containers of liquid and solid medications without any mingling of the two types of medications occurring. The safety container can also store and secure medical equipment and supplies used in the administration of medications, as well as other items. The lid of the safety container is secured to the receptacle of the safety container by a slidable elongated bolt which engages a flange located on the receptacle. The slidable elongated bolt can be held in place by a lock. Multiple units of the safety container can be joined together through a tongue-and-groove configuration located on opposing walls of the receptacles. In another embodiment, a safety container is described which allows the lid to move horizontally with respect to the receptacle. The lid is prevented from being raised upwardly be at least one flange which abuts at least aperture located on one sidewall of the lid. The lid can be further secured by placing a lock through a pair of hasps located on the endwalls of the lid and receptacle.

16 Claims, 15 Drawing Sheets

SAFETY CONTAINER FOR STORING ITEMS

FIELD OF THE INVENTION

This invention relates generally to storage devices, and more particularly to a safety container for storing vnous medications and other potentially dangerous materials and items.

BACKGROUND OF THE INVENTION

The use of tamper resistant containers, or safety containers, is well known in the art and is utilized for many different types of goods and items. Modernly, these containers have been widely used with respect to medications and other related items. Primarily, these containers have been used to store and secure those medications which could represent a potential health hazard if ingested by children, mentally impaired adults, or recovering substance abusers. Historically, these containers have been used to secure prescription medications, especially narcotics, stimulants, sedatives, and other potentially dangerous medications. However, ingestion to the point of abuse of even over-the-counter medications can theoretically cause severe health problems.

The development of these tamper resistant or safety containers has resulted in a number of various devices and configurations. Most of the attention has focused on the caps (also referred to as the lids or tops) of the containers. For example, some types of containers which have locking caps are well known and are widely used commercially. Typically, a key is used to secure and unlock a safety cap which fits snugly over the container which actually stores the medications. In certain devices, a combination lock integrated into the cap secures the cap to the container.

Other devices utilize either pins, bead and recess configurations, sliding bars, or pivoting latching mechanisms to secure the cap to the container. Conventionally, these safety caps have required multiple actions to accomplish removal of the caps. Thus, for example, some safety caps have required the user to press inwardly on a portion of the cap while simultaneously twisting the cap to achieve removal of the cap. Other safety caps have required the user to twist the cap in a first direction, lift it slightly and, then, twist it in a second direction in order to remove the cap. Numerous other multiple action safety caps have been proposed. However, many of them have been so complicated to remove that even authorized persons have had difficulty in removing the caps. Other safety caps have been ineffective and can be removed by anyone with little or no effort. Still other safety caps have been complex devices which have been prohibitively expensive to manufacture and purchase.

Furthermore, most of the safety caps have been useful with either solid or liquid medications, but have not been adaptable for interchangeable or simultaneous multiple media use. The term "simultaneous multiple media" refers to the ability of a safety container to store various medications in both solid and liquid form at the same time without any mingling or contacting of the two forms of medications occurring. Therefore, these previously developed containers may have only been able to store pills or capsules, but could not safely or adequately store liquid medications at the same time. Additionally, these previously developed containers are generally not large enough to safely store several different types of medications, regardless of medium, at the same time.

Finally, these containers are not well suited to storing and securing other potentially dangerous materials or items which are generally used or needed in connection with or in conjunction with the administration of medications. These potentially dangerous materials include, but are not limited to, needles, hypodermic syringes, thermometers, asthma inhalers, medicine droppers, bandages, adhesive tape, tweezers, or scissors.

Examples of various safety containers can be found in U.S. Pat. No. 3,973,687 to Glick; U.S. Pat. No. 4,462,501 to Franchi; U.S. Pat. No. 4,535,903 to Franchi; U.S. Pat. No. 5,284,262 to O'Nan; U.S. Pat. No. 5,346,069 to Intini; and U.S. Pat. No. 5,575,399 to Intini, the entire specifications of which are expressly incorporated herein by reference.

Therefore, there is a need for a container wherein the contents of the container can be secured from unauthorized users, and which can simultaneously and safely store a number of various medications, regardless of form or medium, as well as other potentially dangerous materials or items used in connection with the administration of medications.

OBJECTS OF THE INVENTION

Accordingly, it is an object of the present invention to provide a new and improved container.

It is a further object of the present invention to provide a new and improved safety container.

It is a further object of the present invention to provide a new and improved safety container for storing medications and other dangerous items.

It is a further object of the present invention to provide a new and improved safety container for storing medications and other dangerous items, wherein the lid of the container can be locked in a closed position.

It is a further object of the present invention to provide a new and improved safety container for storing medications and other dangerous items, wherein the lid of the container can be locked in a closed position, wherein the lock means comprises a combination lock.

It is a further object of the present invention to provide a new and improved safety container for storing medications and other dangerous items, wherein the lid of the container can be locked in a closed position, wherein the lock means comprises a combination lock, wherein the combination lock is programmable by the user.

It is a further object of the present invention to provide a new and improved container which is inexpensive to manufacture and purchase and which is simple to operate.

It is a further object of the present invention to provide a new and improved safety container which is inexpensive to manufacture and purchase and which is simple to operate.

It is a further object of the present invention to provide a new and improved safety container for storing medications and other dangerous items, wherein the safety container is inexpensive to manufacture and purchase and which is simple to operate.

It is a further object of the present invention to provide a new and improved safety container for storing medications and other dangerous items, wherein the lid of the container can be locked in a closed position, wherein the safety container is inexpensive to manufacture and purchase and which is simple to operate.

It is a further object of the present invention to provide a new and improved safety container for storing medications and other dangerous items, wherein the lid of the container can be locked in a closed position, wherein the lock means comprises a combination lock, wherein the safety container is inexpensive to manufacture and purchase and which is simple to operate.

It is a further object of the present invention to provide a new and improved safety container for storing medications and other dangerous items, wherein the lid of the container can be locked in a closed position, wherein the lock means comprises a combination lock, wherein the combination lock is programmable by the user, wherein the safety container is inexpensive to manufacture and purchase and which is simple to operate.

It is a further object of the present invention to provide a new and improved container which can be used with solid and liquid substances simultaneously.

It is a further object of the present invention to provide a new and improved safety container which can be used with solid and liquid substances simultaneously.

It is a further object of the present invention to provide a new and improved safety container for storing medications and other dangerous items which can be used with solid and liquid substances simultaneously.

It is a further object of the present invention to provide a new and improved safety container for storing medications and other dangerous items, wherein the lid of the container can be locked in a closed position, wherein the safety container can be used with solid and liquid substances simultaneously.

It is a further object of the present invention to provide a new and improved safety container for storing medications and other dangerous items, wherein the lid of the container can be locked in a closed position, wherein the lock means comprises a combination lock, wherein the safety container can be used with solid and liquid substances simultaneously.

It is a further object of the present invention to provide a new and improved safety container for storing medications and other dangerous items, wherein the lid of the container can be locked in a closed position, wherein the lock means comprises a combination lock, wherein the combination lock is programmable by the user, wherein the safety container can be used with solid and liquid substances simultaneously.

It is a further object of the present invention to provide a new and improved container, wherein the container contains a plurality of removable partition means disposed therein.

It is a further object of the present invention to provide a new and improved safety container, wherein the container contains a plurality of removable partition means disposed therein.

It is a further object of the present invention to provide a new and improved safety container for storing medications and other dangerous items, wherein the container contains a plurality of removable partition means disposed therein.

It is a further object of the present invention to provide a new and improved safety container for storing medications and other dangerous items, wherein the lid of the container can be locked in a closed position, wherein the container contains a plurality of removable partition means disposed therein.

It is a further object of the present invention to provide a new and improved safety container for storing medications and other dangerous items, wherein the lid of the container can be locked in a closed position, wherein the lock means comprises a combination lock, wherein the container contains a plurality of removable partition means disposed therein.

It is a further object of the present invention to provide a new and improved safety container for storing medications and other dangerous items, wherein the lid of the container can be locked in a closed position, wherein the lock means comprises a combination lock, wherein the combination lock is programmable by the user, wherein the container contains a plurality of removable partition means disposed therein.

It is a further object of the present invention to provide a new and improved container which can be coupled to at least one other container. It is a further object of the present invention to provide a new and improved safety container which can be coupled to at least one other safety container.

It is a further object of the present invention to provide a new and improved safety container for storing medications and other dangerous items, wherein the safety container can be coupled to at least one other safety container.

It is a further object of the present invention to provide a new and improved safety container for storing medications and other dangerous items, wherein the lid of the container can be locked in a closed position, wherein the safety container can be coupled to at least one other safety container.

It is a further object of the present invention to provide a new and improved safety container for storing medications and other dangerous items, wherein the lid of the container can be locked in a closed position, wherein the lock means comprises a combination lock, wherein the safety container can be coupled to at least one other safety container.

It is a further object of the present invention to provide a new and improved safety container for storing medications and other dangerous items, wherein the lid of the container can be locked in a closed position, wherein the lock means comprises a combination lock, wherein the combination lock is programmable by the user, wherein the safety container can be coupled to at least one other safety container.

These and other objects of the present invention will become more fully apparent from the following detailed description, taken with reference to the figures of the accompanying drawings contained herein.

SUMMARY OF THE INVENTION

In accordance with one aspect of the present invention, the foregoing and other objects are achieved by:

a receptacle, the receptacle having a base, the receptacle having a pair of spaced and opposed endwalls upwardly depending from the base, the receptacle having a pair of spaced and opposed sidewalls upwardly depending from the base, the upwardly depending endwalls having a raised flange extending vertically across the top portion of the upwardly depending endwalls, the flange having an area defining an aperture, the flanges being located at an opposed position on their respective upwardly depending endwalls so as to align their respective apertures;

a lid, the lid having a base, the lid having a pair of spaced and opposed endwalls downwardly depending from the base, the lid having a pair of spaced and opposed sidewalls downwardly depending from the base, the lid being connected to the receptacle by a hinge means, the pair of downwardly depending endwalls having an area defining an aperture located in a centralized area of the pair of downwardly depending endwalls, the apertures of the flanges aligning with the apertures of the pair of downwardly depending endwalls;

an elongated bolt, the elongated bolt having a length substantially equal to the lid, the elongated bolt having a notch in proximity to one end of the elongated bolt, the elongated bolt being housed within the lid, the elongated bolt being supported by supporting means, the elongated bolt being capable of being manipulated back and forth along its horizontal axis, the elongated bolt being capable of passing through the apertures of the flanges and the apertures of the pair of downwardly depending endwalls, the elongated bolt being capable of assuming a position so as to abut the flange in order to prevent the disengagement of the lid from the receptacle, the elongated bolt being capable of assuming a position so as to align the notch with the flange in order to facilitate the disengagement of the lid from the receptacle; and a lock means, the lock means being housed in the lid, the lock means being capable of engaging the elongated bolt so as to immobilize the elongated bolt.

In accordance with another aspect of the present invention, the foregoing and other objects are achieved by:

a lid having a base, the lid having a pair of spaced and opposed endwalls downwardly depending from the base, the lid having a pair of spaced and opposed sidewalls downwardly depending from the base, the pair of downwardly depending endwalls having an area defining an aperture;

an elongated bolt, the elongated bolt having a length substantially equal to the lid, the elongated bolt having a notch in proximity to one end of the elongated bolt, the elongated bolt being housed within the lid, the elongated bolt being supported by supporting means, the elongated bolt being capable of being manipulated back and forth along its horizontal axis, the elongated bolt being capable of passing through the apertures of the pair of downwardly depending endwalls, the elongated bolt being capable of assuming a position so as to prevent the disengagement of the lid from the receptacle, the elongated bolt being capable of assuming a position so as to align the notch in order to facilitate the disengagement of the lid from said receptacle; and a lock means, the lock means being housed in the lid, the lock means being capable of engaging the elongated bolt so as to immobilize the elongated bolt.

In accordance with another aspect of the present invention, the foregoing and other objects are achieved by:

a lid, the lid having a first hasp, the lid having at least one downwardly depending sidewall, the lid having at least one downwardly depending endwall, the first hasp being located on the downwardly depending endwall, the downwardly depending sidewall having at least one area defining an aperture, the lid having a downwardly extending projection located on the interior surface of the lid;

a receptacle, the lid being attached to the receptacle by a hinge means, the hinge means allowing the lid to be moved back and forth horizontally with respect to the receptacle, the receptacle having a second hasp, the second hasp being located below the first hasp, the first hasp and the second hasp aligning vertically, the receptacle having at least one upwardly depending sidewall, the receptacle having at least one upwardly depending endwall, the second hasp being located on the upwardly depending endwall, the upwardly depending sidewall having at least one upwardly extending flange, the aperture being capable of assuming a position so as to prevent the disengagement of the lid from the receptacle, the aperture being capable of assuming a position so as to facilitate the disengagement of the lid from the receptacle.

DETAILED DESCRIPTION OF THE INVENTION

Figure 1:
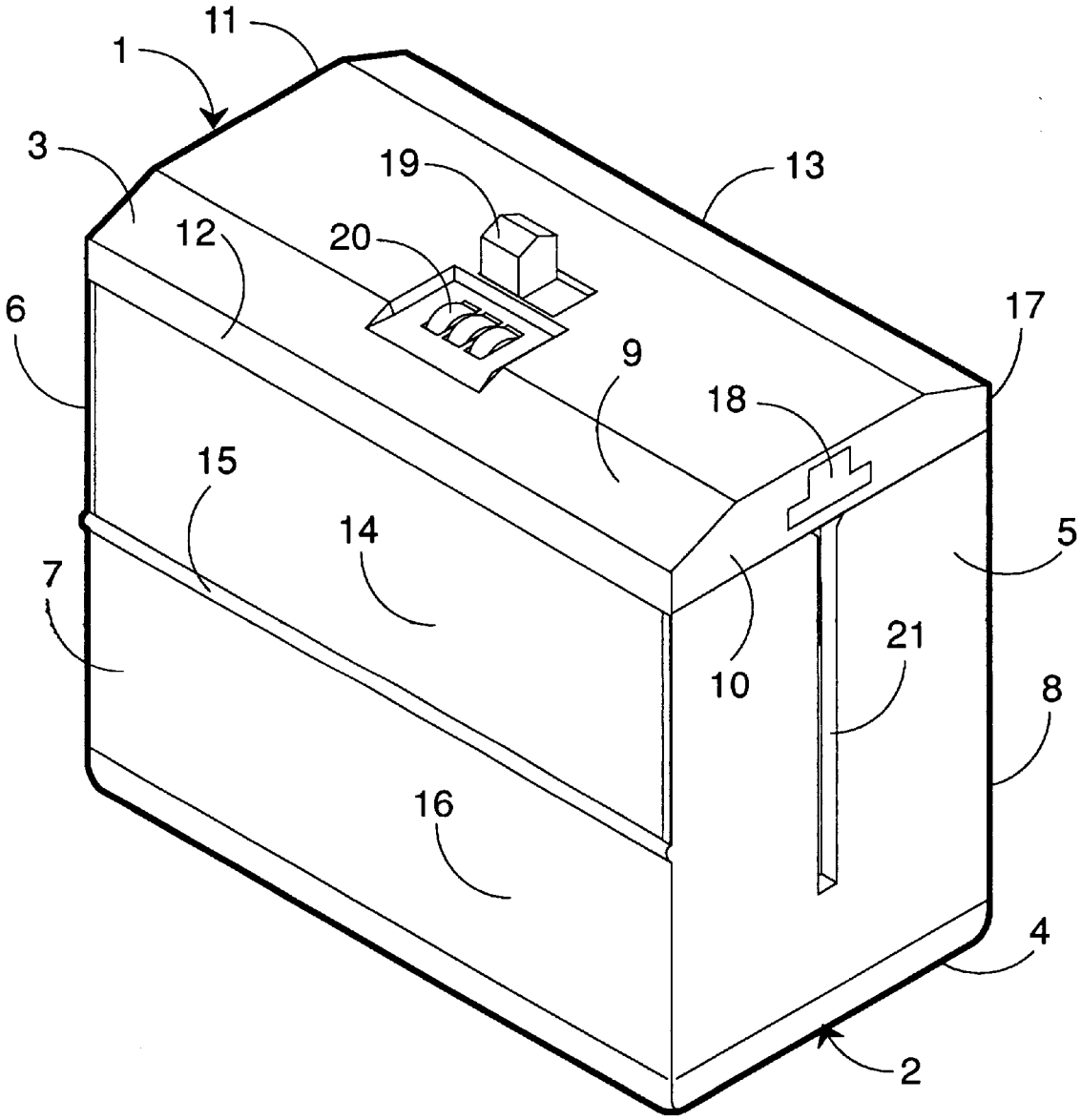
FIG. 1 is a perspective view of a safety container in accordance with one aspect of the present invention.

Referring to FIG. 1, a safety container in accordance with one aspect of the present invention is illustrated. The safety container is generally denominated by the numeral 1. The safety container 1 consists primarily of a bottom receptacle portion 2 and a top lid portion 3. The bottom receptacle portion 2 is generally rectangular in shape, however other configurations are envisioned (i.e., a square). The bottom receptacle portion 2 consists primarily of a base 4, a pair of spaced and opposed upwardly depending endwalls 5 and 6, and a pair of spaced and opposed upwardly depending sidewalls 7 and 8 (endwall 6 and sidewall 8 are not visible due to the orientation of FIG. 1). Endwall 5 contains a receiving means 21 (i.e., a recessed groove extending vertically from the top of endwall 5 down to point approximately below the midpoint of endwall 5) for receiving another safety container unit, this feature to be more fully explained later in the detailed description. Sidewall 7 includes a top panel 14 which can be extended outwardly and downwardly away from the bottom receptacle portion 2 in order to allow the user to gain easy access to the contents of the bottom receptacle portion 2. The top panel 14 is connected to the bottom panel 16 by a hinge means 15. The hinge means 15 can merely be two strips of plastic or fabric which join the bottom portion of the top panel 14 to the top portion of the bottom panel 16, however other configurations are envisioned. Preferably, the hinge means 15 is integrated between the top panel 14 and the bottom panel 16 as opposed to taking up a large amount of room inside the bottom receptacle portion 2. Base 4 can be adapted to include a rubber or rubber-like material adhered onto its outer surface in order to provide a secure, non-slip grip on various surfaces. Additionally, the base 4 can have rounded corners in order to prevent injuries that might occur with pointed corners or edges.

Still referring to FIG. 1, the top lid portion 3 is also generally rectangular in shape, however other configurations are envisioned (i.e., a square). Preferably, the top lid portion 3 and the bottom receptacle portion 2 have substantially identical area dimensions so that the top lid portion 3 fits snugly over the bottom receptacle portion 2. The top lid portion 3 consists primarily of a panel 9, a pair of spaced and opposed downwardly depending endwalls 10 and 11, and a pair of spaced and opposed downwardly depending sidewalls 12 and 13 (endwall 11 and sidewall 13 are not visible due to the orientation of FIG. 1). The top lid portion 3 is connected to the bottom receptacle portion 2 by means of a hinge means 17 (which is not visible due to the orientation of FIG. 1). The top lid portion 3 also houses a slidable elongated bolt 18 which is used to secure the lid portion 3 to the bottom receptacle portion 2. The slidable elongated bolt 18 is maneuvered back and forth by an actuator means 19. The slidable elongated bolt 18, once it is in the desired position, is kept from being moved by a lock means 20 located in the panel 9. The lock means 20 engages the slidable elongated bolt 18 by any number of suitable means in order to prevent movement of the slidable elongated bolt 18. For example, the lock means 20 may comprise one or more rods which may engage one or more holes, notches, or recesses in the body of the slidable elongated bolt 18, thus preventing movement when in that particular position. Additionally, the lock means 20 may comprise a combination lock which is programmable by the user in order to provide a higher level of security to the contents of the safety container.

Figure 2:
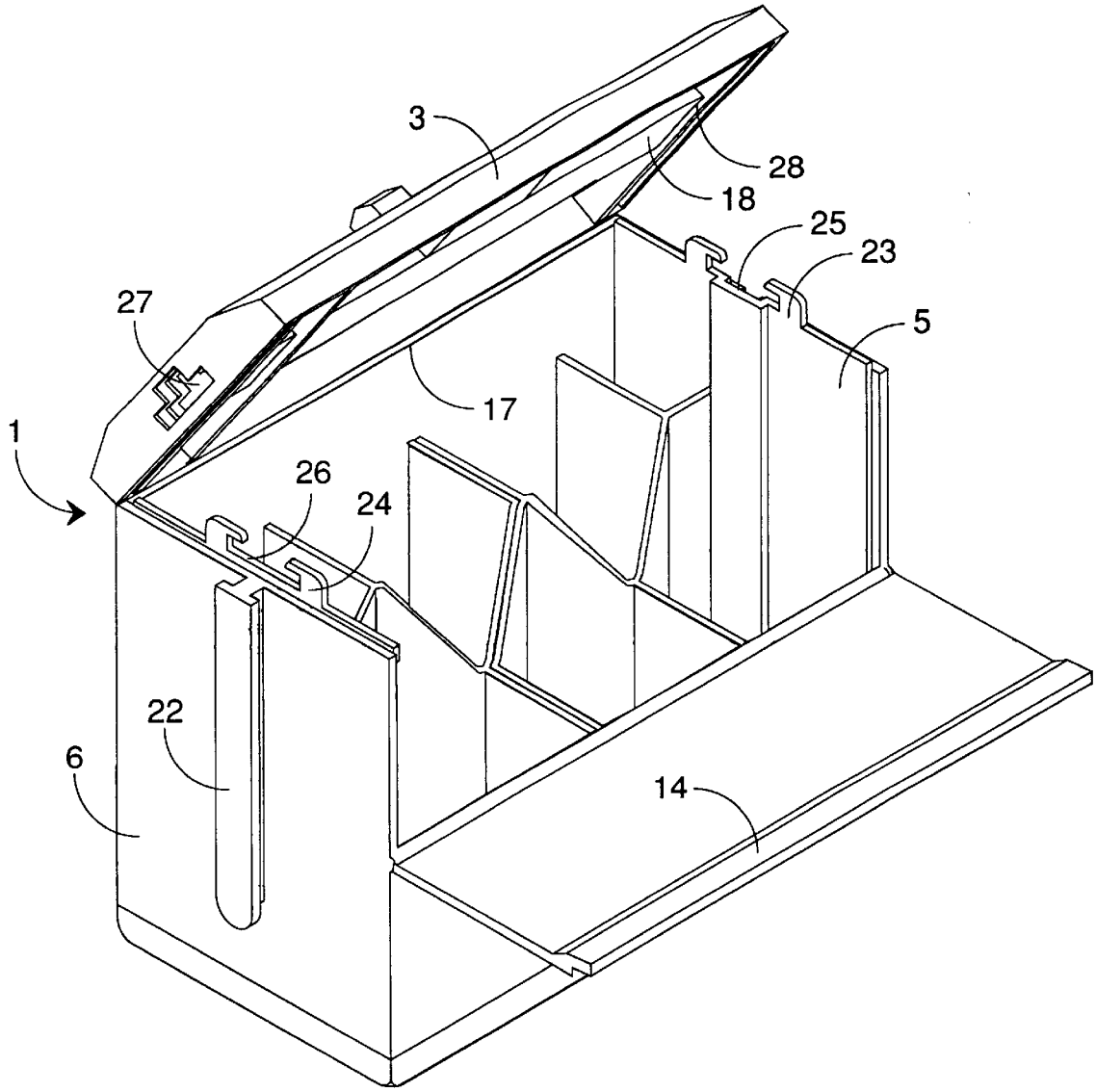
FIG. 2 is a perspective view of a safety container in accordance with another aspect of the present invention.
Figure 5:
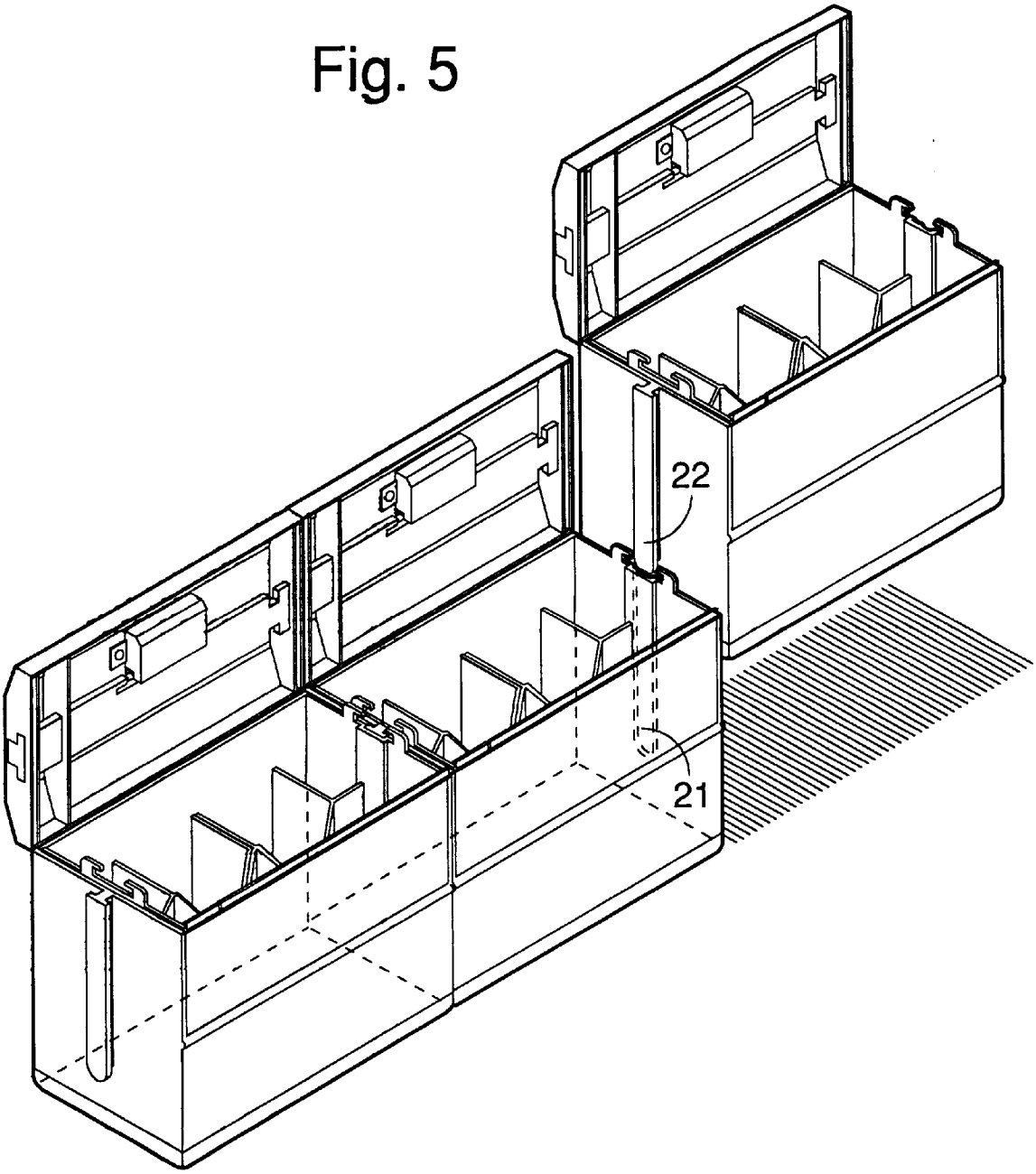
FIG. 5 is a perspective view of a series of safety containers in accordance with another aspect of the present invention.

Referring to FIG. 2, additional features of the safety container in accordance with another aspect of the present invention are illustrated. Here, the top lid portion 3 is illustrated in its open and raised position. Additionally, the top panel 14 is illustrated in its lowered position, allowing the user to gain easy access to the contents of the safety container 1. In this view, the hinge means 17 is also visible. Additionally, the first endwall 6 is also visible. Attached to the first endwall 6 is an attaching means 22 which is used to attach one safety container to the receiving means 21 of another safety container. The attaching means 22 is a centrally located T-shaped projection extending vertically downwardly from the top of the first endwall 6 to a point approximately below the midpoint of first endwall 6. The attaching means 22 is merely lowered down (in the direction of the arrow) into the recessed grove of the receiving means 21, as is illustrated in FIG. 5 . At the top of endwalls 5 and 6 are flanges 23 and 24, respectively. Flanges 23 and 24 have centrally located notches or apertures 25 and 26 for loosely receiving the slidable elongated bolt 18. The top lid portion 3 also contains a pair of apertures 27 and 28 which loosely receive the slidable elongated bolt 18 in order to allow it to pass therethrough in order to lock and unlock the top lid portion 3 from the bottom receptacle portion 2. Therefore, it is critical that the exact locations of apertures 25, 26, 27, and 28 align properly in order to allow the slidable elongated bolt 18 to pass easily therethrough.

Figure 3:
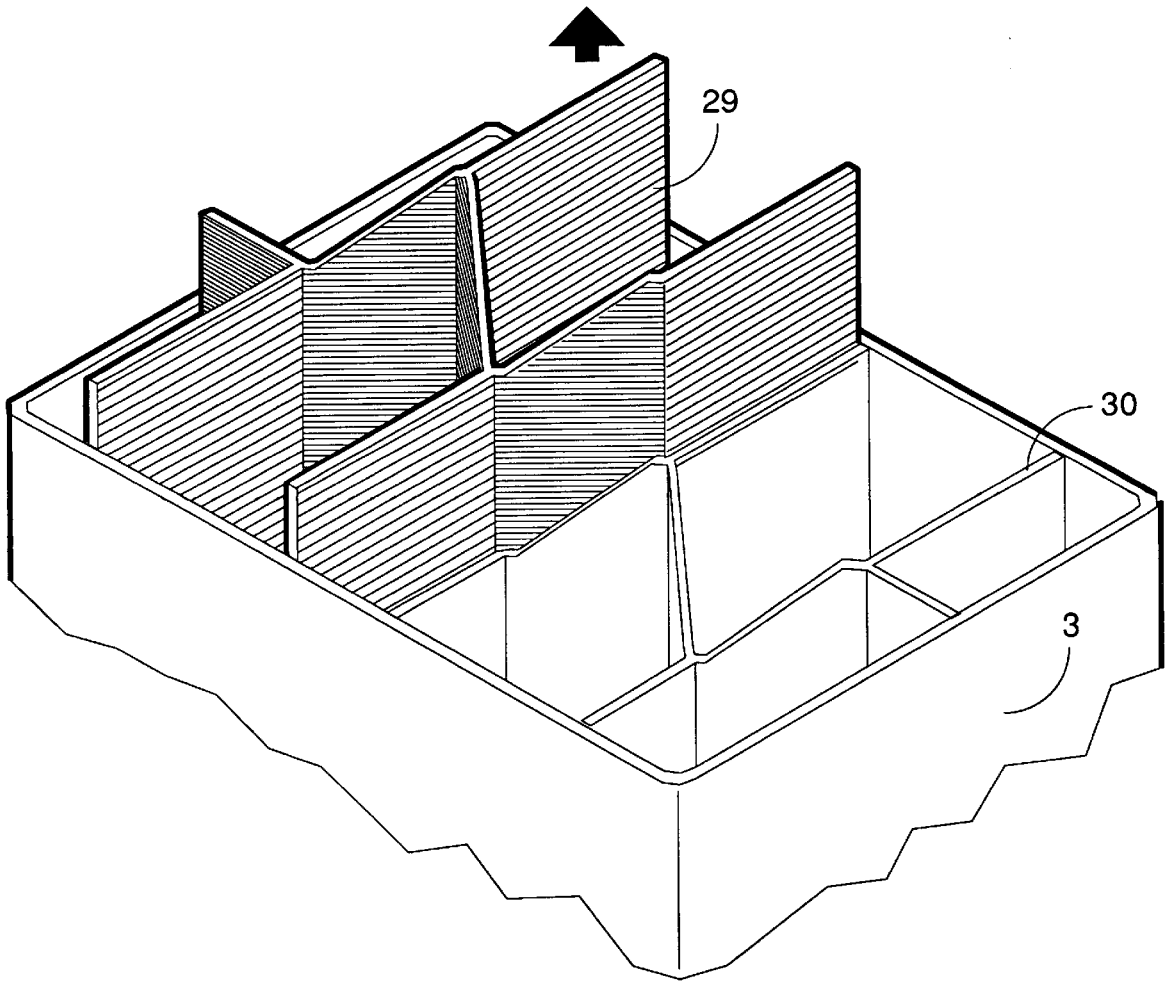
FIG. 3 is a partial perspective view of a safety container in accordance with another aspect of the present invention.

Referring to FIG. 3, additional features of the safety container in accordance with another aspect of the present invention are illustrated. Here, inside the bottom receptacle portion 2, at least one removable partition means 29 is disposed within the bottom receptacle portion 2. Additional removable partition means 30 may be disposed within the bottom receptacle portion if desired. The removable partition means 29 and 30 are generally panels configured in a honeycomb shape for space efficiency purposes, however other configurations are envisioned. The removable partition means 29 and 30 are used to safely store and segregate various medications and medical supplies. However, it should be noted that the safety container of the present invention can store and secure many other types of items besides medications and medical supplies. Therefore, the maximum height of the removable partition means 29 and 30 should be approximately equal to the internal height of the bottom receptacle portion 2.

Figure 4:
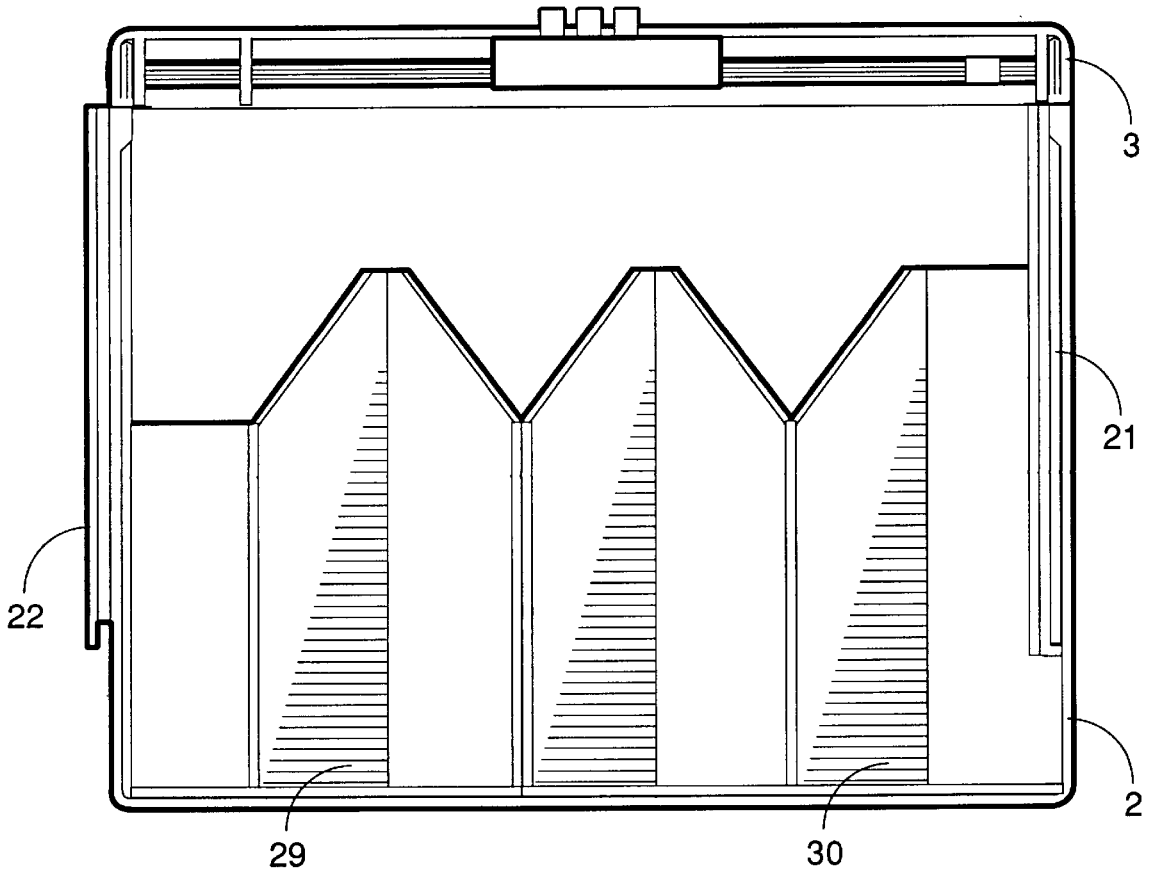
FIG. 4 is a cross-sectional view of a safety container in accordance with another aspect of the present invention.
Figure 11:
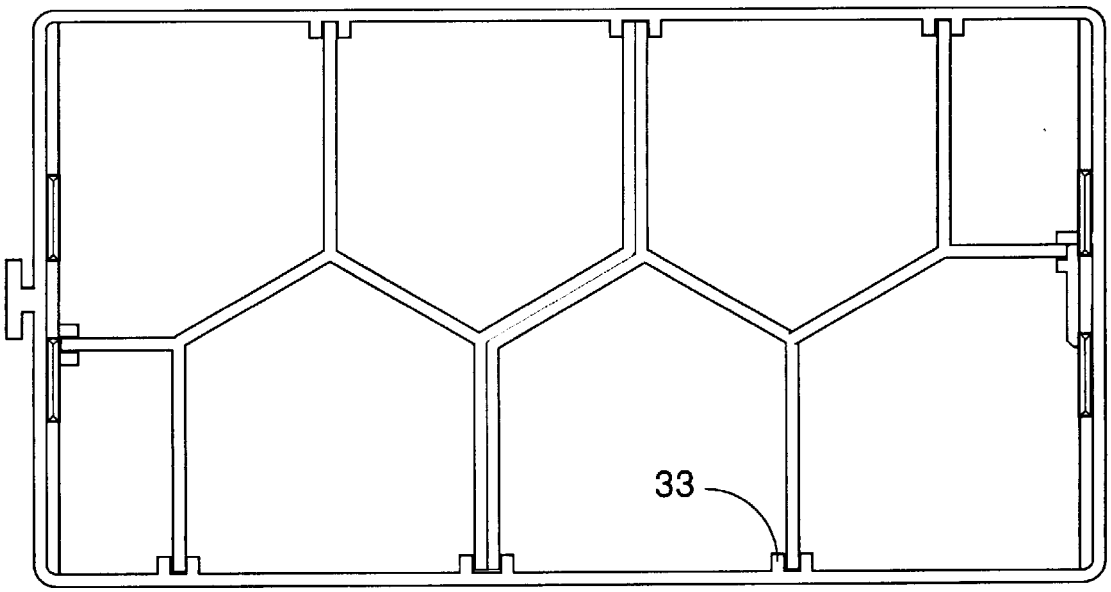
FIG. 11 is a partial top view of a safety container in accordance with another aspect of the present invention.

Referring to FIG. 4, additional features of the safety container in accordance with another aspect of the present invention are illustrated. Here, the removable partition means 29 and 30 are illustrated disposed within the bottom receptacle portion 2. Additionally the lid portion 3 is shown on top of the bottom receptacle portion 2 in the closed position. Additionally, the receiving means 21 and the attaching means 22 are also illustrated. Referring to FIG. 11, an overhead view of the removable partition means 29, 30 is illustrated. A plurality of groove means 33 is provided to secure the removable partition means 29, 30 in order to prevent excessive movement during transportation.

Figure 6:
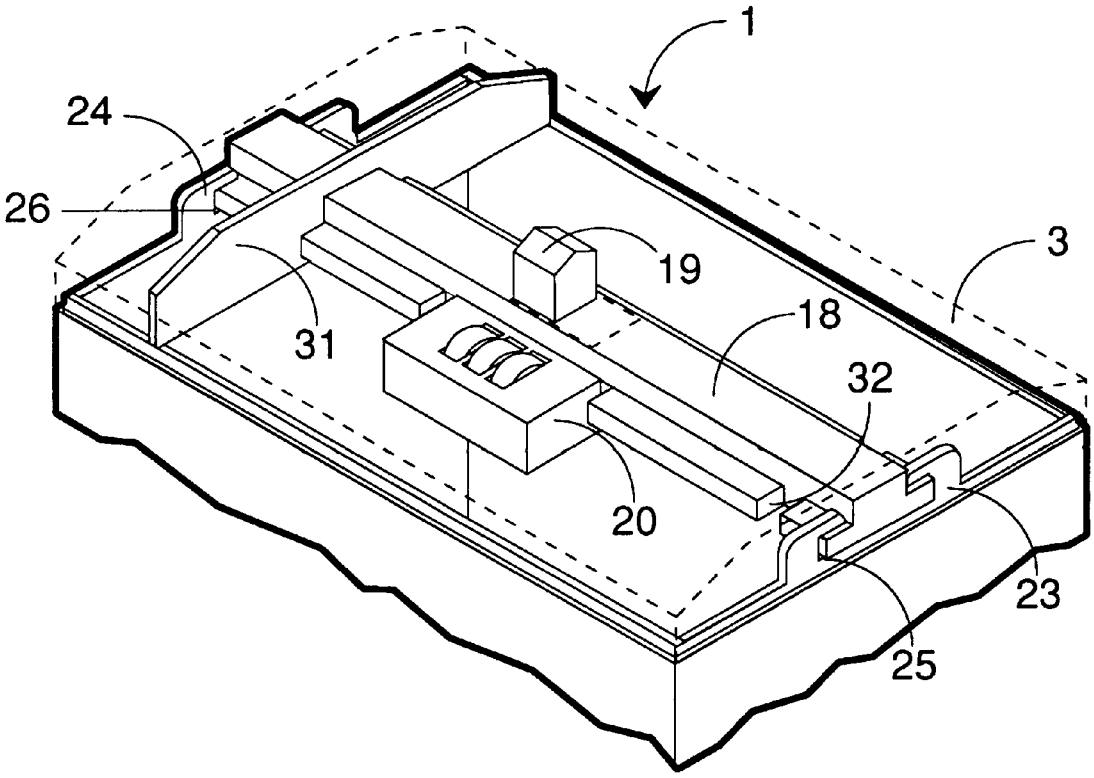
FIG. 6 is partial perspective view of a safety container in accordance with another aspect of the present invention.
Figure 9:
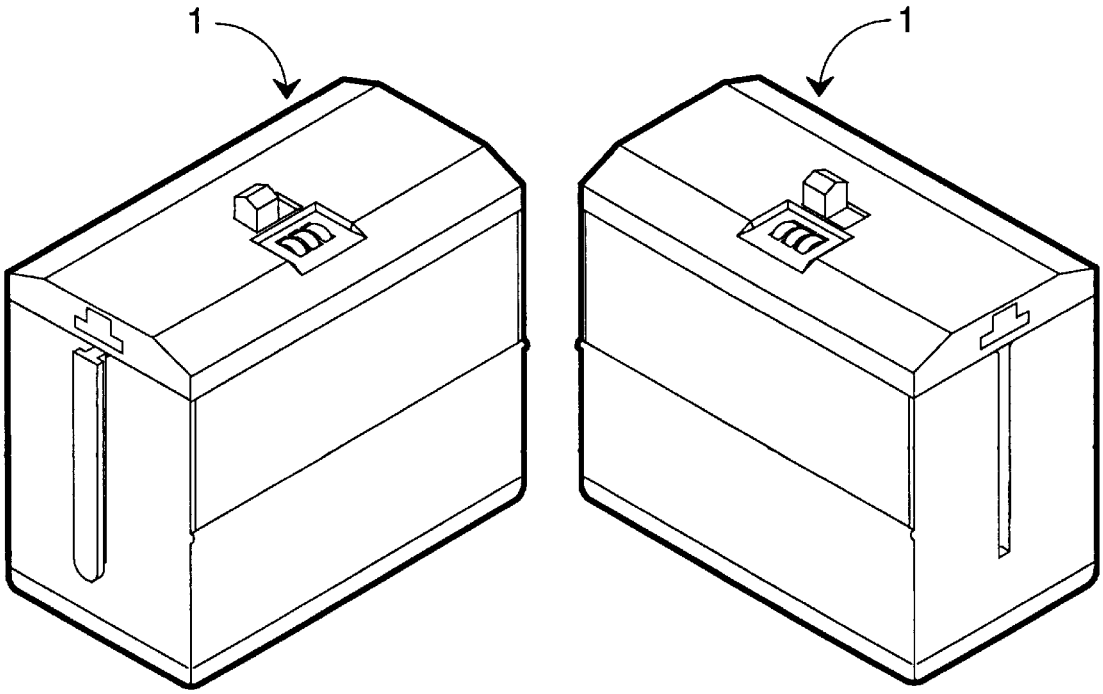
FIG. 9 is perspective view of a pair of safety containers in accordance with another aspect of the present invention.

Referring to FIG. 6, additional features of the safety container in accordance with another aspect of the present invention are illustrated. Here, the upper lid portion 3 is shown in a "see-through" manner. In this illustration, the safety container 1 is shown in its "locked" position. The slidable elongated bolt 18, actuator means 19, flanges 23, 24, lock means 20, notches 25, 26 are shown. Additionally, a support means 31 is provided to support the slidable elongated bolt 18. Finally, a notch 32 is provided in one end of the slidable elongated bolt 18. Attention is drawn to the fact that the entire length of the elongated slidable bolt 18 is housed within the panel 9. In this configuration the upper lid portion 3 can not be raised upwardly from the bottom receptacle portion 2 because the slidable elongated bolt 18 would abut flanges 23, 24. Therefore, no matter how much force is used, it would be virtually impossible to open the safety container 1 in its locked position without causing serious and highly visible structural damage to it. In order to keep the slidable elongated bolt 18 in place, a lock means 20 is provided to engage a portion of the slidable elongated bolt 18. It is envisioned that a portion of the slidable elongated bolt 18 can be employed to abut the lock means 20 in order to prevent the movement of the slidable elongated bolt 18. FIG. 9 provides a perspective view of the left and right hand side views of the safety container 1 in the locked position.

Figure 7:
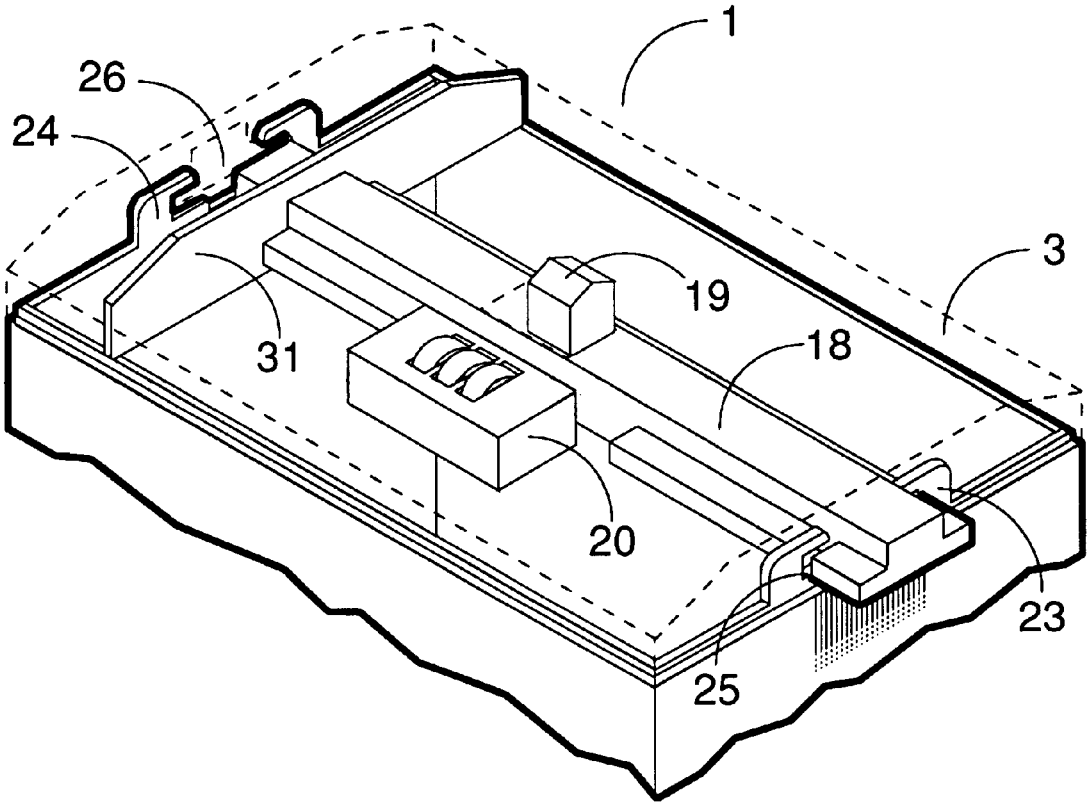
FIG. 7 is partial perspective view of a safety container in accordance with another aspect of the present invention.
Figure 10:
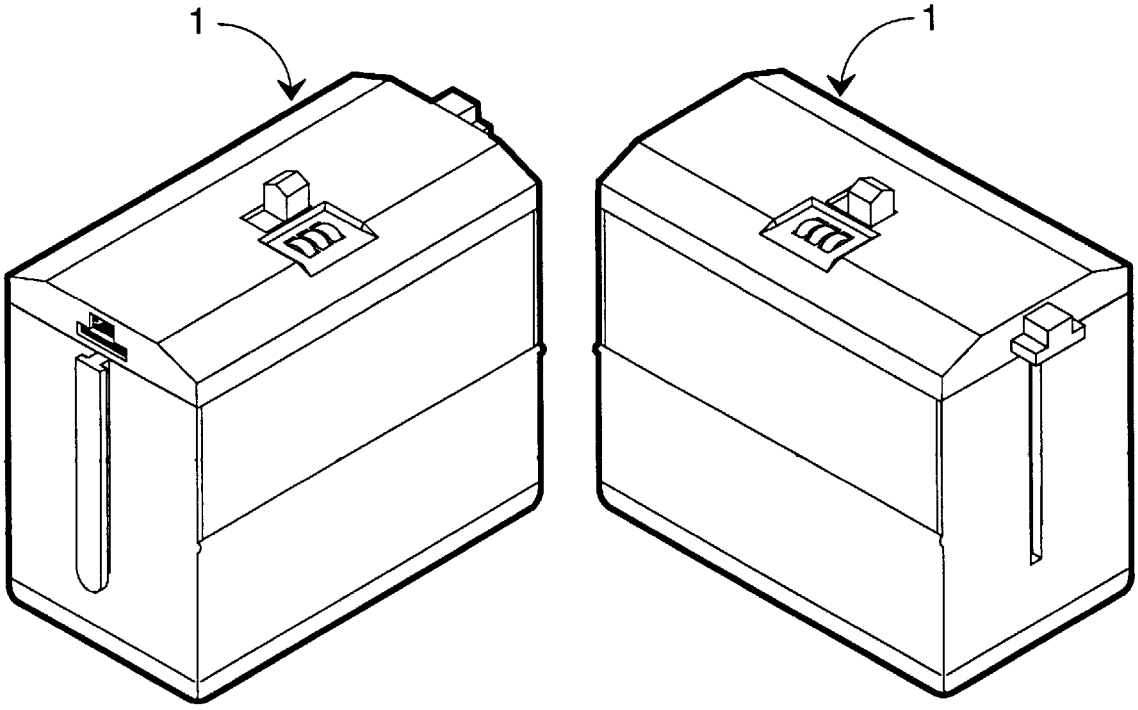
FIG. 10 is perspective view of a pair of safety containers in accordance with another aspect of the present invention.

Referring to FIG. 7, additional features of the safety container in accordance with another aspect of the present invention are illustrated. Again, the upper lid portion 3 is shown in a "see-through" manner. However, in this illustration, the safety container 1 is shown in its "unlocked" position. The slidable elongated bolt 18, actuator means 19, flanges 23, 24, lock means 20, notches 25, 26 are also shown. However, notch 32 is not visible due to the orientation of the slidable elongated bolt 18. Attention is drawn to the fact that only a portion of the length of the elongated slidable bolt 18 is housed within the panel 9, and that a small end portion of the slidable elongated bolt 18 protrudes outwardly from notch 25. In this configuration the upper lid portion 3 can be raised upwardly from the bottom receptacle portion 2 because the slidable elongated bolt 18 would not abut flanges 23, 24. Specifically, notch 32 would pass freely through flange 23. FIG. 10 provides a perspective view of the left and right hand side views of the safety container 1 in the unlocked position.

Figure 8A:
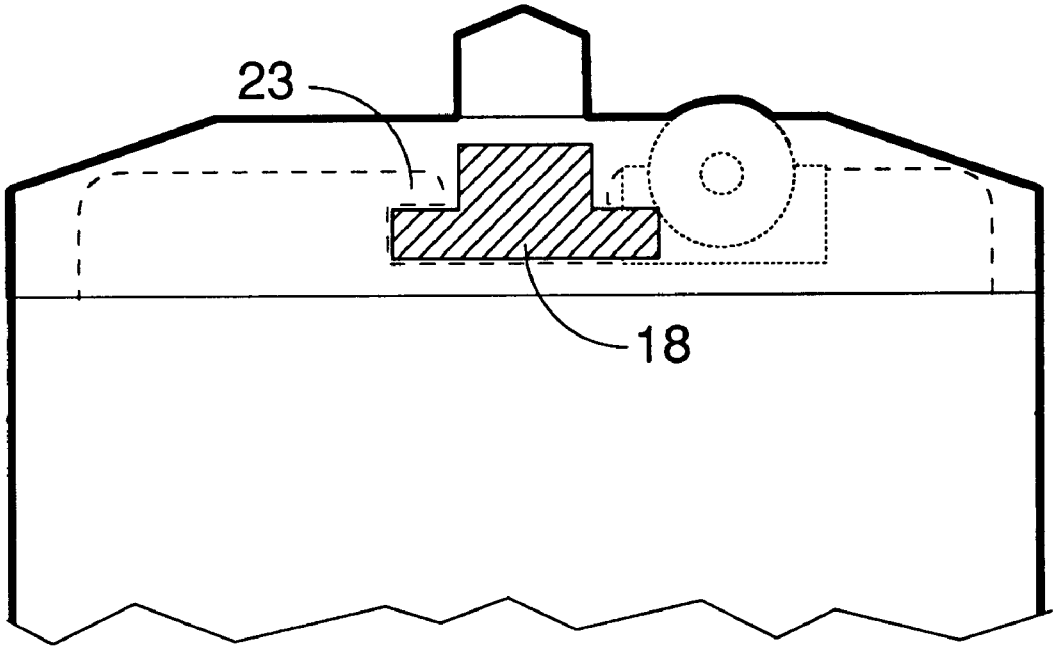
FIG. 8*a* is a partial cross-sectional view of a safety container in accordance with another aspect of the present invention.
Figure 8B:
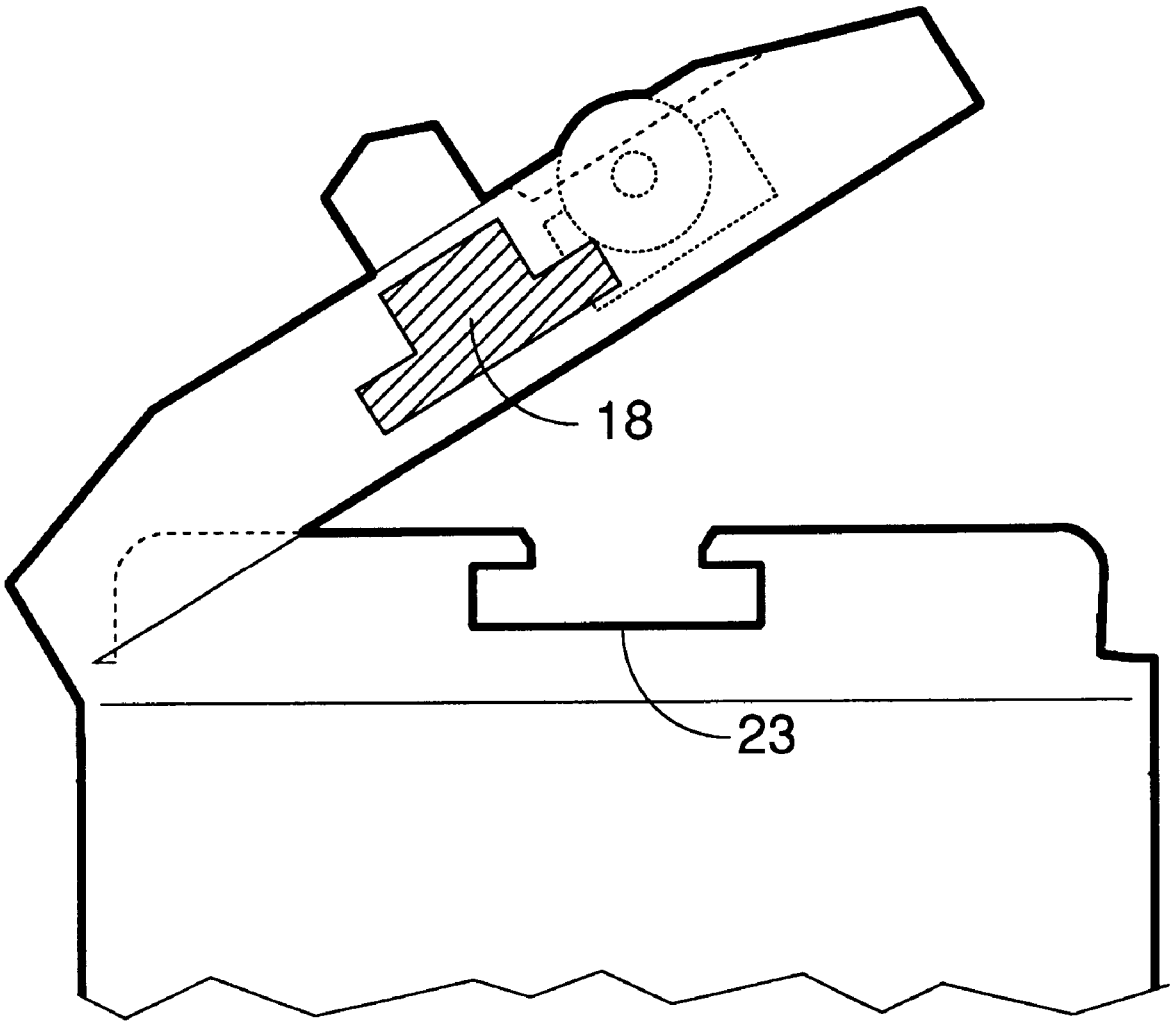
FIG. 8*b* is a partial cross-sectional view of a safety container in accordance with another aspect of the present invention.

FIGS. 8*a* and 8*b* provide partial cross-sectional views of the interaction between the slidable elongated bolt 18 and flange 23 in the locked and unlocked positions.

Referring again to FIG. 5, it will be appreciated that the safety containers of the present invention can be joined together by utilizing the "tongue and groove" configuration (i.e., receiving means 21 and attaching means 22) provided on the sides of the containers. Initially, the safety containers should be joined together in the position wherein the slidable elongated bolt is housed entirely within the lid (i.e., no portion of the slidable elongated bolt protrudes out of the lid). This is preferable in order to prevent the end of the slidable elongated bolt of one safety container abutting the top lid portion of another safety container it is to be joined with. Once the safety containers are joined together, their respective lock means can engage their respective slidable elongated bolts. When a user wants to unlock and access all of the joined safety containers, he or she merely disengages all of the lock means and with one simple motion manipulates the slidable elongated bolt of the end or terminal safety container in the direction of the notched ends of the slidable elongated bolts of the other safety containers. Therefore, all of the safety containers can be accessed at the same time, instead of the user having to individually manipulate each and every slidable elongated bolt of every safety container.

Figure 12A:
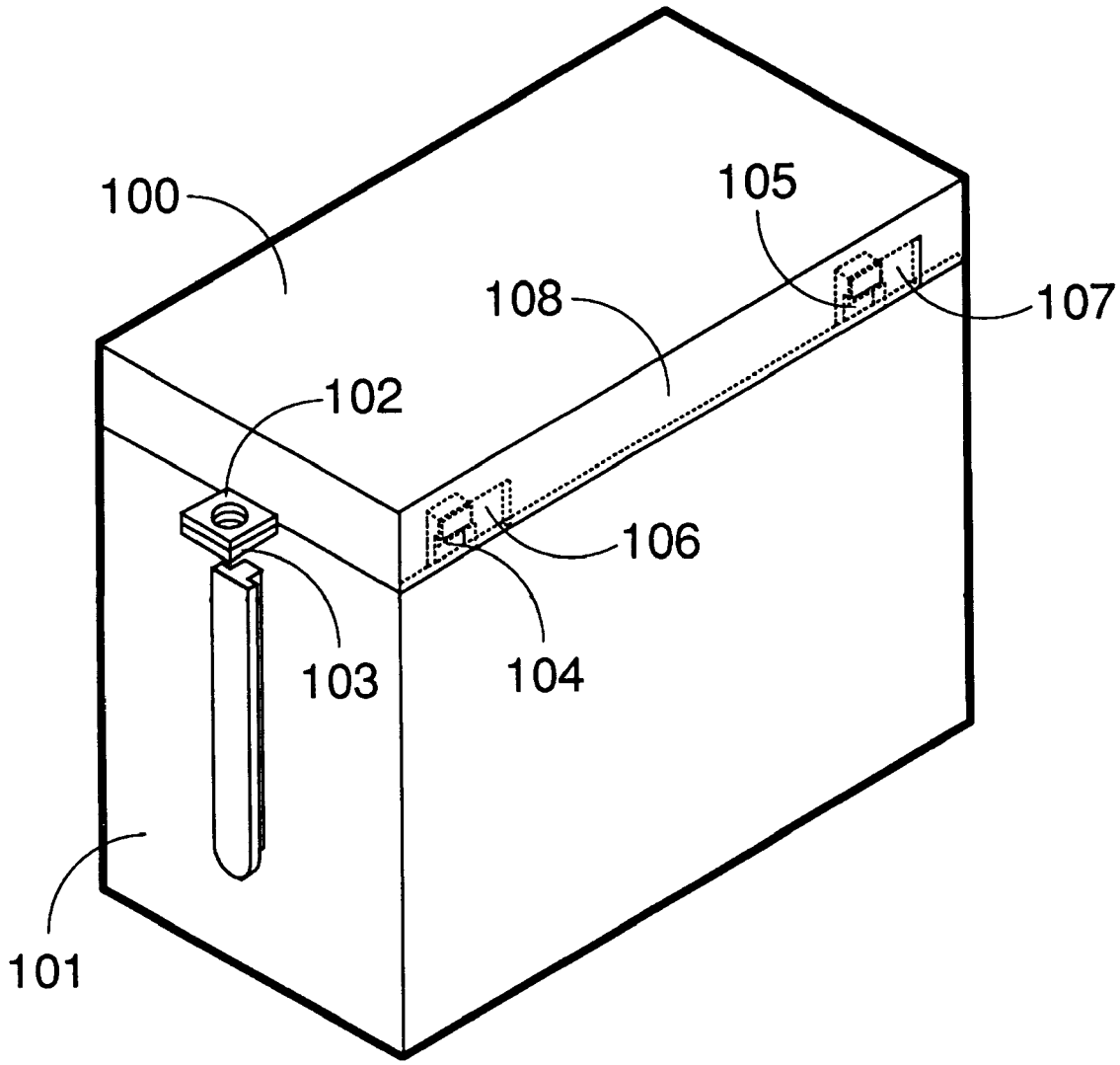
FIG. 12*a* is perspective view of an alternative embodiment of a safety container in accordance with another aspect of the present invention.

Referring to FIG. 12*a*, there is illustrated an alternative embodiment of the present invention. This version of the safety container consists primarily of a rectangularly shaped lid 100 and a rectangularly shaped receptacle 101. It should be noted that other shapes of this alternate version are envisioned. The lid 100 is connected to the receptacle 101 by a hinge means which allows the lid 100 to move back and forth horizontally with respect to the receptacle 101 (i.e., a sliding pin hinge, spring hinge, or any similar configuration). On one side of the lid 100 is a hasp 102. On the same side of the receptacle 101 is a hasp 103, which is located directly below hasp 102. The safety container can be secured in this position by placing a lock (specifically a padlock) through hasps 102 and 103. On the front downwardly depending sidewall 108 of the lid 100 are a pair of apertures 106, 107. Abutting these apertures are a pair of flanges 104, 105, which prevent the lid 100 from being raised upwardly away from the receptacle 101, even if the hasps 102, 103 are not secured by a lock. Apertures 106, 107 are shaped so as to abut flanges 104, 105 when the lid 100 is in one position, and not abut flanges 104, 105 when the lid 100 is in another position. In this particular illustration the apertures are L-shaped; however, other configurations are envisioned.

Figure 12B:
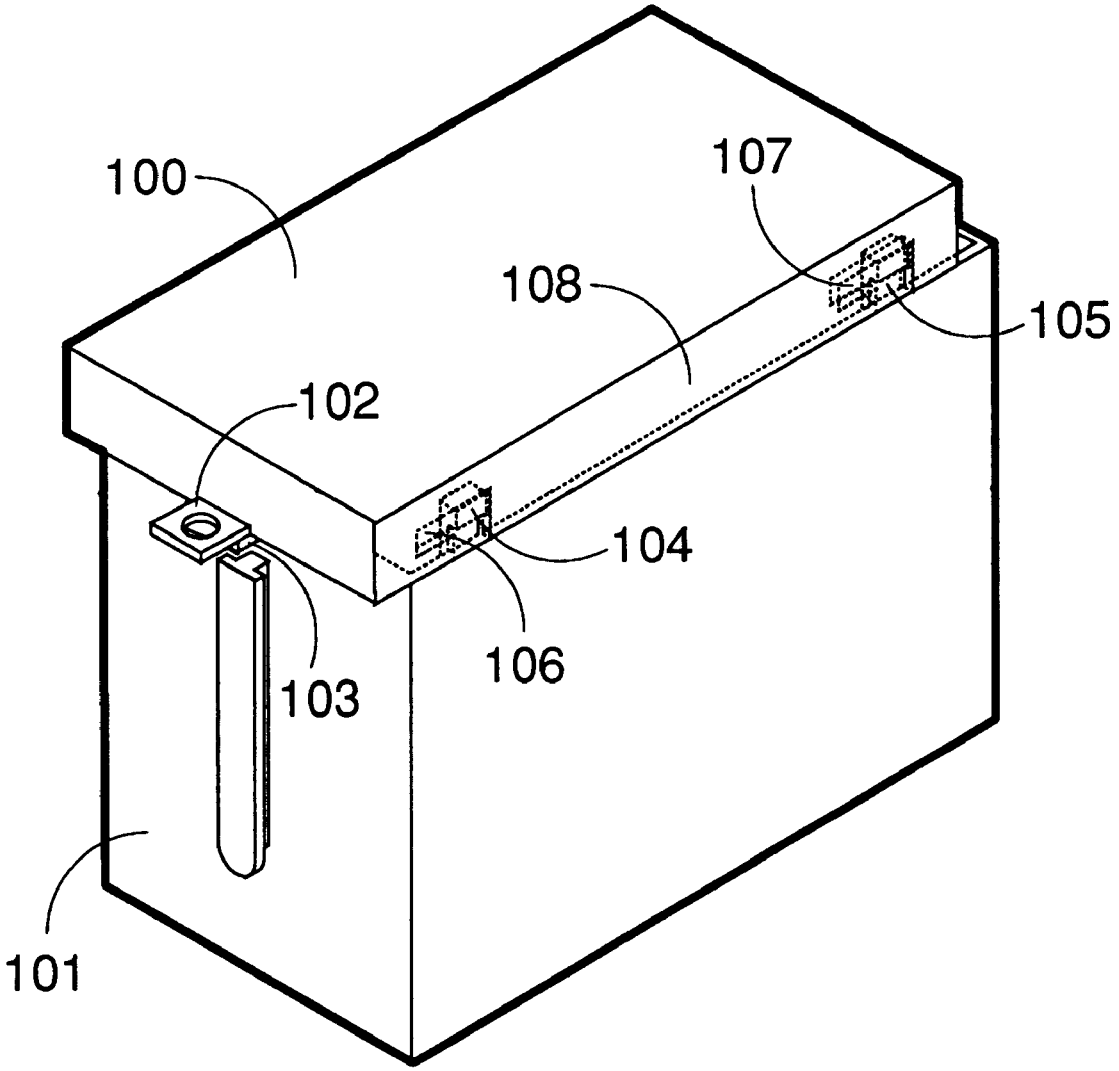
FIG. 12*b* is perspective view of an alternative embodiment of a safety container in accordance with another aspect of the present invention.

Referring to FIG. 12*b*, in this illustration the lid 100 is shown as being moved horizontally away from the receptacle 101. Here, the apertures 106, 107 have been positioned so as to allow the lid 100 to be raised upwardly because flanges 104, 105 no longer abut apertures 106, 107.

Figure 12C:
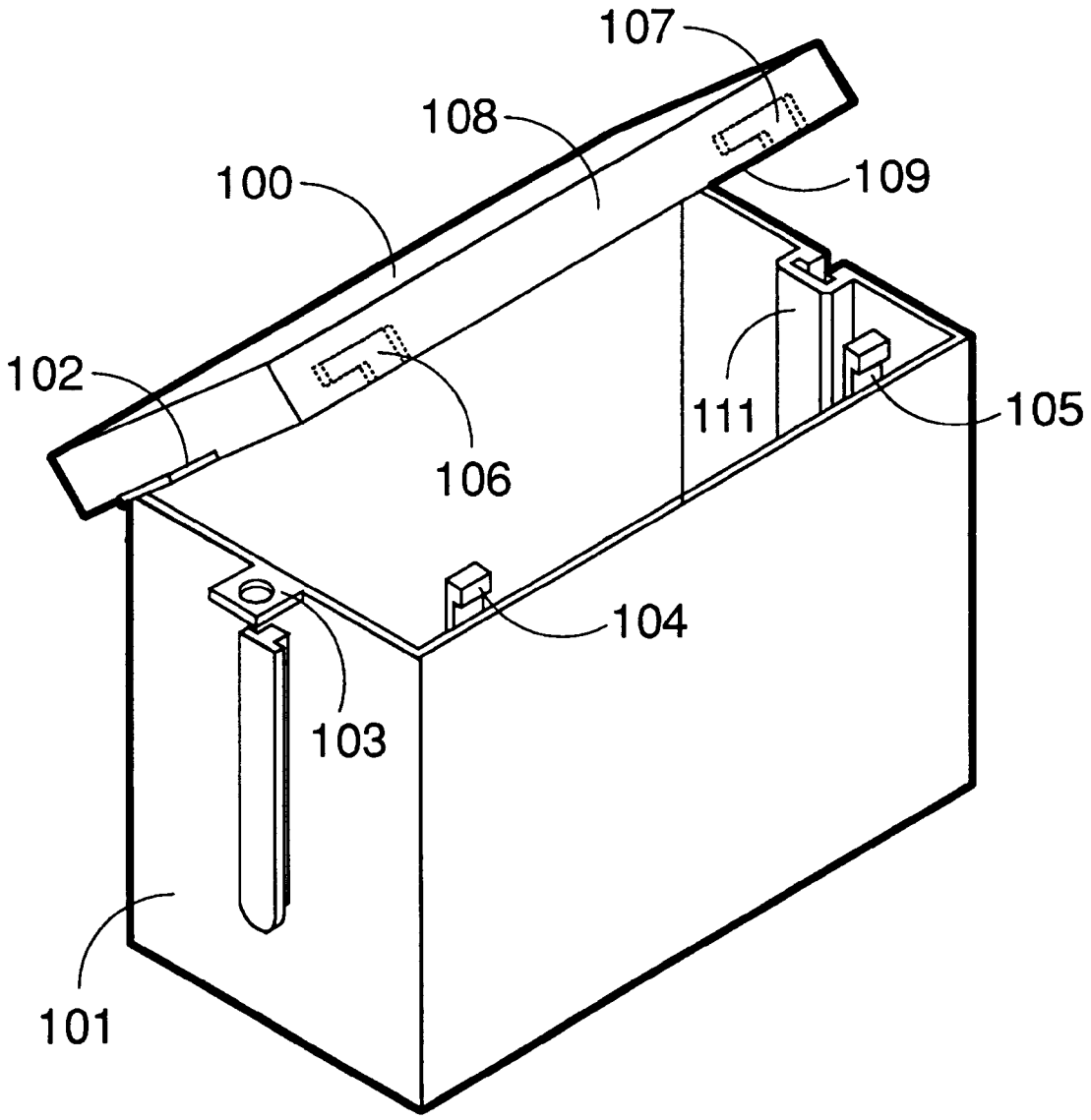
FIG. 12*c* is perspective view of an alternative embodiment of a safety container in accordance with another aspect of the present invention.

Referring to FIG. 12*c*, in this illustration the lid 100 is shown in its raised position.

As with the previously described version of the safety container, this version can be equipped with partition means and groove means. Additionally, other units of this safety device can be coupled together. For example, a projection 109 can be provided which extends downwardly from the inner surface of the lid 100. The hasp of another unit can be positioned so that projection 109 extends through both hasps, as lid 100 is being closed. The first unit can be padlocked, thus securing both units simultaneously. It is also envisioned that this embodiment of the safety container can also be equipped with the attaching means 110 and receiving means 111, previously described with respect to other embodiments.

While preferred embodiments of the present invention have been shown and described, it will be understood that there is no intent to limit the invention by such disclosure, but rather, it is intended to cover all modifications and alternate embodiments falling within the spirit and scope of the invention as defined in the appended claims.

What is claimed is:

1. A container comprising:

a receptacle, said receptacle having a base, said receptacle having a pair of spaced and opposed endwalls upwardly depending from said base to a top portion, said receptacle having a pair of spaced and opposed sidewalls upwardly depending from said base to a top portion, said upwardly depending endwalls having a raised flange extending vertically across the top portion of said upwardly depending endwalls, said flange having an area defining an aperture, said flanges being located at an opposed position on their respective upwardly depending endwalls so as to align their respective apertures;

a lid, said lid having a top panel, said lid having a pair of spaced and opposed endwalls downwardly depending from said top panel, said lid having a pair of spaced and opposed sidewalls downwardly depending from said top panel, said lid being connected to said receptacle by a hinge for moving the lid into a closed position and an open position relative to the receptacle, said pair of downwardly depending endwalls having an area defining an aperture located in a centralized area of said pair of downwardly depending endwalls, the apertures of said flanges aligning with the apertures of said pair of downwardly depending endwalls when the lid is in the closed position;

an elongated bolt, said elongated bolt having an axial length substantially corresponding to a separation distance between the apertures of said pair of downwardly depending endwalls, said elongated bolt having a notch in proximity to one end of said elongated bolt, said elongated bolt being housed within said lid, said elongated bolt being supported by supporting means, said elongated bolt being capable of being manipulated back and forth along its axis, said elongated bolt being capable of passing through the apertures of said flanges and the apertures of said pair of downwardly depending endwalls, said elongated bolt being capable of assuming a position so as to pass through said flange in order to prevent the disengagement of said lid from said receptacle, said elongated bolt being capable of assuming a position so as to align said notch with said flange in order to facilitate the disengagement of the lid from said receptacle; and a lock means, said lock means being housed in said lid, said lock means being capable of engaging said elongated bolt so as to immobilize axial manipulation of said elongated bolt.

2. A container in accordance with claim 1, wherein said container stores and secures medication containers, said medication containers containing solid medications.

3. A container in accordance with claim 1, wherein said container stores and secures medication containers, said medication containers containing liquid medications.

4. A container in accordance with claim 1, wherein said container simultaneously stores and secures medication containers containing liquid medications and medication containers containing solid medications.

5. A container in accordance with claim 1, wherein said lock means comprises a combination lock.

6. A container in accordance with claim 1, wherein said elongated bolt contains an actuator means disposed on the top surface of said elongated bolt for moving said elongated bolt.

7. A container in accordance with claim 1, further comprising at least one removable partition for creating a plurality of partitioned areas within said receptacle, said removable partition means being disposed within said receptacle.

8. A container in accordance with claim 1, further comprising a receiving means on the outer surface of one of the upwardly depending sidewalls and an attaching means on the outer surface of the opposed upwardly depending sidewall, said receiving means of one container being for connecting said one container to the attaching means of a first other container, and said attaching means for connecting said one container to the receiving means of a second other container.

9. A container in accordance with claim 7, wherein said removable partition means are flat panels arranged in a honeycomb configuration.

10. A container in accordance with claim 7, further comprising a plurality of securing means for securing said removable partition means within said receptacle.

11. A container in accordance with claim 8, wherein an attaching means of one container engages the receiving means of the first other container, said attaching means of the one container being for connecting said one container to said first other container, and said receiving means of the first other container being for connecting said first other container to said one container.

12. A lid for use in conjunction with a receptacle, comprising:

a lid having a base, said lid having a pair of spaced and opposed endwalls downwardly depending from said base, said lid having a pair of spaced and opposed sidewalls downwardly depending from said base, said pair of downwardly depending endwalls having an area defining an aperture;

an elongated bolt, said elongated bolt having a length substantially equal to said lid, said elongated bolt having a notch in proximity to one end of said elongated bolt, said elongated bolt being housed within said lid, said elongated bolt being supported by supporting means, said elongated bolt being capable of being manipulated back and forth along its horizontal axis, said elongated bolt being capable of passing through the apertures of said pair of downwardly depending endwalls, said elongated bolt being capable of assuming a position so as to prevent the disengagement of said lid from said receptacle, said elongated bolt being capable of assuming a position so as to align said notch in order to facilitate the disengagement of said lid from said receptacle; and a lock means, said lock means being housed in said lid, said lock means being capable of engaging said elongated bolt so as to immobilize said elongated bolt.

13. A container as described by claim 1 wherein at least one of said receptacle sidewalls further comprises an upper panel and a lower panel secured together by a hinge for permitting rotation of said upper panel about a hinge axis away from said lid.

14. A safety container having an internal volume enveloped by a receptacle and a cooperative lid:

said receptacle comprising a base panel and first and second pairs of opposed receptacle walls, said receptacle walls being secured to said base panel and projecting therefrom to respective top edges, said first pair of opposed receptacle walls including flange means structurally secured to said receptacle walls to project past respective wall top edges wherein said flange means have respectively aligned slide bolt apertures, said first pair of opposed receptacle walls having attaching means for securing an adjacent safety container thereto, said attaching means comprising an elongated internal groove shape within one receptacle wall of said first pair extending at least partially between said base panel and the respective top edge, the other receptacle wall of said first pair having a projection therefrom with an external shape substantially conforming to that of said groove shape to mesh longitudinally therein whereby the projection of one safety container may be meshed with and extracted from a groove in another safety container only by displacement of one safety container relative to the other in a direction substantially perpendicular to the respective base panels of the meshing safety containers; and, said lid comprising a top panel and first and second pairs of opposed lid walls, said lid walls being secured to said top panel and protecting therefrom to respective lid edges, one of said lid edges being pivotally joined to one of said receptacle wall top edges whereby the remainder of said lid edges may be rotated to and from juxtaposition with the remainder of said receptacle wall top edges, another of said lid edges being rotatable to a position overlying said groove that prevents extraction of the projection of another safety container meshed with said groove, said first pair of opposed lid walls including respectively aligned slide bolt apertures wherein said slide bolt apertures in said lid walls align with said slide bolt apertures in said flange means when said lid edges are juxtaposed with said wall top edges, said lid including an axially elongated slide bolt secured to said lid for selective axial displacement in opposite directions within said internal volume wherein said slide bolt has an axial length substantially corresponding to a distance between the slide bolt apertures in said first pair of opposed lid walls.

15. A safety container as described by claim 14 wherein said lid is secured to said receptacle when said slide bolt is positioned to simultaneously penetrate said slide bolt apertures in said lid walls and said flange means.

16. A safety container as described by claim 15 wherein said lid is released to rotate about a pivot joint between said one lid edge and said one wall top edge when said slide bolt is withdrawn from one of said slide bolt apertures respective to a lid wall and a flange means.

* * * * *